United States Patent [19]

Linzey

[11] Patent Number: 5,027,796

[45] Date of Patent: Jul. 2, 1991

[54] GUM MASSAGER

[76] Inventor: Robert P. Linzey, 3129 Rosacie Ave., Baltimore, Md. 21234

[21] Appl. No.: 533,865

[22] Filed: Jun. 6, 1990

Related U.S. Application Data

[63] Continuation-in-part of Ser. No. 409,719, Sep. 20, 1989, abandoned.

[51] Int. Cl.[5] ..... A61H 7/00

[52] U.S. Cl. ..... 128/62 A; 15/167.1

[58] Field of Search ..... 128/62 A, 66; 433/142; 15/167.1; 132/321

[56] References Cited

U.S. PATENT DOCUMENTS

| | | | |
|---|---|---|---|
| 1,002,468 | 9/1911 | Strangman | 128/62 A |
| 1,318,964 | 10/1919 | Chess | 128/62 A |
| 1,987,390 | 1/1935 | Davis | 128/62 A |
| 2,176,309 | 10/1939 | Love et al. | 128/62 A |
| 2,196,284 | 4/1940 | Ackerman | 128/62 A |
| 2,217,439 | 10/1940 | Fuller | 15/167.1 |
| 3,359,588 | 12/1967 | Kobler | 128/62 A |
| 4,205,664 | 6/1980 | Baccialon | 128/62 A |
| 4,373,541 | 2/1983 | Nishioka | 15/167.1 |

FOREIGN PATENT DOCUMENTS

| | | | |
|---|---|---|---|
| 87/07500 | 12/1987 | World Int. Prop. O. | 128/66 |

*Primary Examiner*—John J. Wilson

*Attorney, Agent, or Firm*—Roylance, Abrams, Berdo & Goodman

[57] ABSTRACT

A periodontal tool for use in promoting good oral hygiene by helping to control both oral plaque and inflammation of gingiva tissues (gums) is disclosed. A half-cylinder shaped head or mouthpiece, comprising sturdy, relatively short, closely packed nodules, is attached to a handle device, whereby it can provide a gently stimulating action.

16 Claims, 2 Drawing Sheets

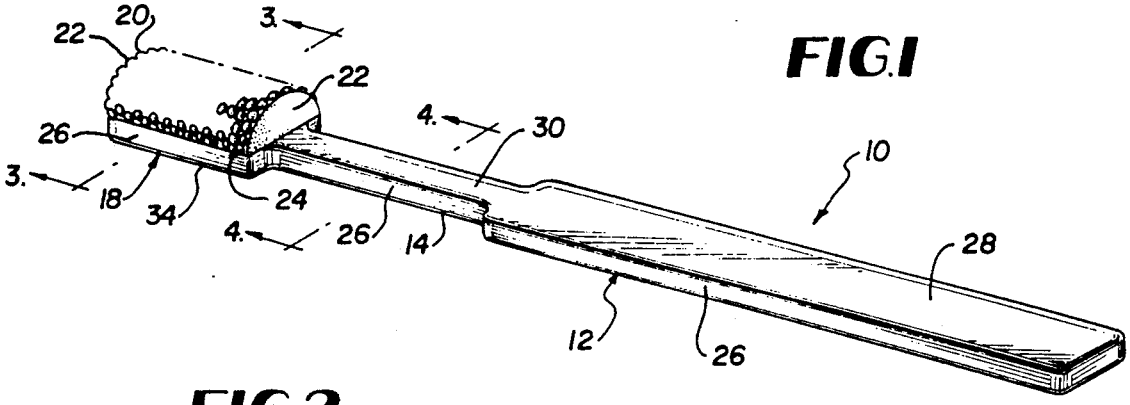
FIG.1
FIG.2
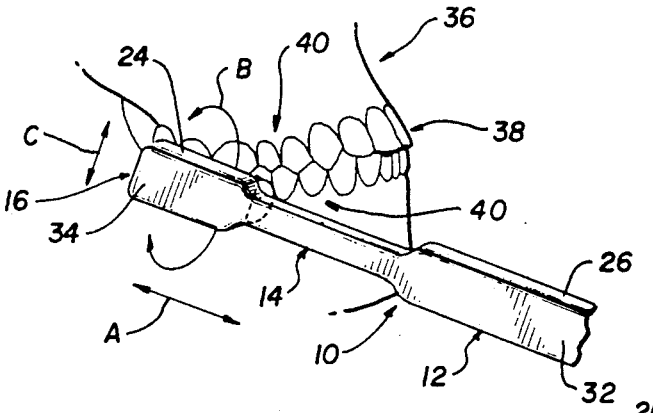
FIG.3
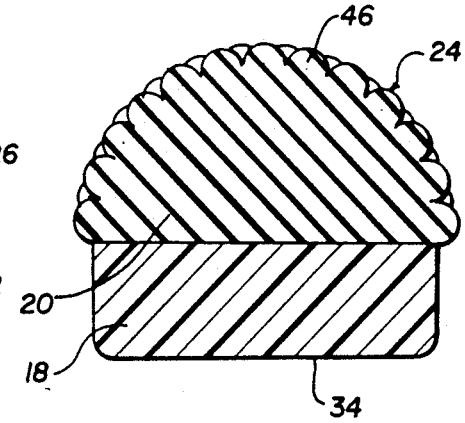
FIG.6
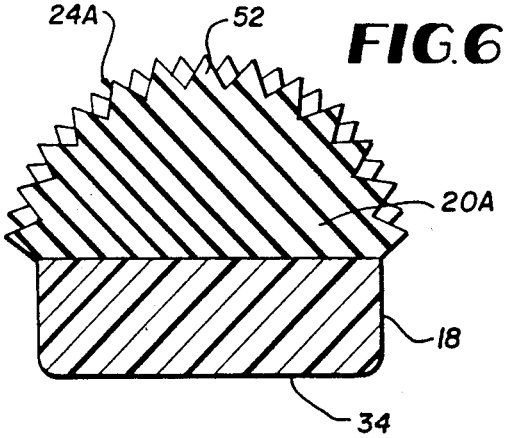
FIG.4
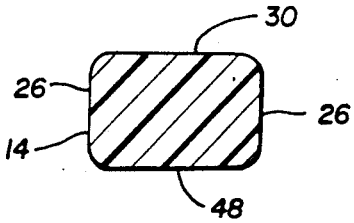
FIG.7
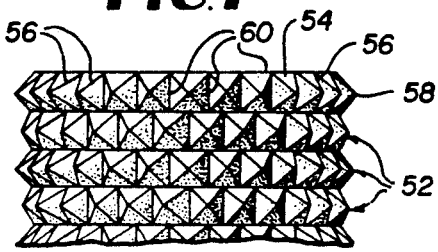
FIG.5
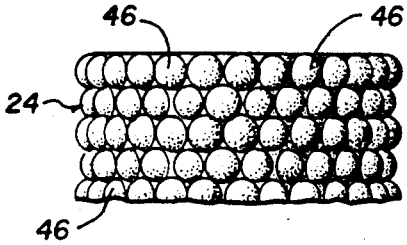

GUM MASSAGER

REFERENCE TO RELATED APPLICATION

This application is a continuation-in-part of my co-pending U.S. Pat. application Ser. No. 07/409,719, now abandoned, filed Sept. 20, 1989, the entire disclosure of which is hereby incorporated by reference as if herein set forth in full. This utility patent application is also related to my companion co-pending continuation-in-part design patent application, also based on Ser. No. 07/409,719, and filed simultaneously with this application, in that they have similar disclosures.

FIELD OF THE INVENTION

This application relates to the field of periodontal tools useful for gum massage and removal of oral plaque. More particularly, the invention relates to periodontal tools comprising a head, a neck and a handle and having stiff nodules attached to the head or mouthpiece. Thus, a gum massaging means and an oral plaque removal means is provided for facilitating cleaning of the oral cavity and the teeth and especially the gums, and for increasing the supply of blood to the gingiva tissues (gums), thereby helping to promote good oral hygiene.

BACKGROUND OF THE INVENTION

Conventional brushing of the teeth does not effectively stimulate the gingiva tissue in the thicker gum regions. The gums as well as the thinner gingiva tissues need stimulation by a tool which is designed for massaging.

Regular gentle massaging can improve the health of a person's gingiva tissues. Massaging one or more times a day in addition to the regular teeth cleaning by brushing and flossing seems to produce the best results. Also, the massage should not be so painful or difficult as to discourage regular use of the massaging method.

Many people, particularly older people, have tender and inflamed or swollen gums which lead to various dental problems. Such persons often find teeth cleaning to be painful and difficult which discourages them from diligently practicing good dental hygiene. Regular gentle massaging and stimulating of the gums is beneficial in treating or helping to prevent a person's gums from becoming so tender, swollen or inflamed. Accordingly, a good tool for gently massaging gums which is easy and simple to use is needed.

Even though there are a number of tools marketed for use in gum massage, there is much need for improved devices. Many of the massaging devices doubling as auxiliary cleaning devices have relatively hard, pointed projections. Such devices tend to have long relatively stiff projections spaced far apart to facilitate cleaning between the teeth or to have long soft projections located close together but bendable in order to clean between the teeth. Moreover, those devices designed just for massaging the gums, rather than cleaning, tend to be very small or have very limited ability to reach between the teeth or into the corners of the mouth.

Accordingly, there is need for a tool to have both cleaning and massaging abilities which can reach the gums between the teeth as well as the other gum areas, that will reach the corners of the mouth and that will be large enough to ensure that the massaging task will not take an unreasonable amount of time to complete.

Moreover, the massaging tool should be gentle enough on the gums that a person will not find the massaging experience so unpleasant as to be discouraged from using the tool on a daily basis.

OBJECTIVES OF THE INVENTION

An objective of the invention is to provide an improved gum massaging and tooth cleaning implement.

Another objective of the invention is to provide an easy to manipulate gum massaging and tooth cleaning implement which has improved effectiveness.

Another objective of the invention is to provide a periodontal tool having nodules which are soft yet substantially inflexible.

Another objective of the invention is to provide a periodontal tool having a substantially soft, flexible, compressible and resilient head whereupon the nodules are mounted.

Another objective of the invention is to maximize the amount of surface area on the head of the periodontal tool while still permitting good access to the corners of the mouth and between the teeth.

Another objective of the invention is to provide a periodontal tool having a head whose surface is gentle to the gums but sturdy enough to massage without being excessively abrasive.

Another objective of the invention is to provide a periodontal tool having a head comprised of projections close enough together to provide an effective massaging action and yet clean well.

Another objective of the invention is to provide a periodontal tool having a head comprising firm short projections yet capable of giving an effective massage at varying depths so that the gums between the teeth as well as above and below the teeth may be adequately massaged.

SUMMARY OF THE INVENTION

The invention provides methods and apparatus for achieving the above objectives and advantages. More particularly, a periodontal tool comprised of a half-cylinder shaped head (or mouthpiece), a neck and a handle is provided, wherein the head or mouthpiece is comprised of a large number of closely packed soft sturdy nodules of two types, that is, pointed or spherical.

The outer surfaces of the pointed nodules are comprised of isosceles triangles having their sides joined together to form edges of the nodules, and wherein the edges join together to form a point, and wherein the bases of the triangles are all joined to form the sides of a polygon having more than three sides.

The second type of nodules are comprised of half-spheres. Half-spheres or approximately half-spheres are to be distinguished from dome-shaped structures which are substantially less than half-spheres. Dome-shaped structures are formed by passing a plane through a sphere substantially above the equatorial (half-sphere) plane.

The shape of the nodules allows them to be made of relatively soft rubber and yet remain stiff enough to be sturdy. This solves a problem in the art wherein the projections have either been so hard as to reduce their gum massaging effectiveness and require wider spacing to allow the hard projections to reach between the teeth or have been so soft that their gum massaging abilities have been reduced. Further, the prior art hard projections can be abrasive to the mouth and therefore discourage regular gum massaging due to user discomfort.

The unique noduled surface of the tool of the invention together with a soft half-cylinder shaped head effects a gentle stimulating action which is easy on the gums. The gentle stimulating action of the gum massager removes plaque from the gums and increases the supply of blood to the gingiva tissues. Since these gum massages are so gentle to the gums and substantially non-abrasive, a person will not be discouraged from using the massager often to help build strong healthy gums and promote good dental hygiene.

The half cylinder portion or base of the head or mouthpiece is substantially soft, flexible, compressible and resilient. This allows the nodules to be stiffer than would be possible if mounted on a hard or rigid half-cylinder since the base itself can flex to respond to mouth and teeth contours. Also, this allows the half-cylinder portion and the nodules to optionally be made from the same material as one integral piece. Advantages, for example, ease and lower cost of manufacturing, etc. due to a one-piece make-up are readily apparent. Also, in a second embodiment, the head and the noduled surface can be in two pieces, glued or welded together, which provides different advantages, such as using different materials for the noduled surface and the supporting half-cylinder or base.

The points of contact (tangency) formed by the half-cylinder shape of the mouthpiece can be represented by a straight line. This shape exhibits the best balance between gum contact and the ability to reach the rear portions of the mouth. The surface area contacting the gums due to the points of contact available on a half-cylinder is greater than that of a corresponding size sphere. Further, the ability to reach the corners of the mouth when using the half-cylinder shaped head or mouthpiece of the invention is greater than when using a head with a flat surface area.

Even though the surface area contacting the teeth and gums in the rest of the mouth is less for the half-cylinder shaped head than for a flat shaped head when the head is moved back and forth in the mouth, the contacting surface area of the half-cylinder is effectively greater since an up and down rotational movement of the massager head allows more contact for the half-cylinder and this motion is not at all possible or practicable for a flat surface unless the nodules are very long. Moreover, the half-cylinder shaped head is superior to a full-cylinder shaped head since the half-cylinder allows easier access to the corners of the mouth while keeping more surface contact area due to its thinner size permitting a wider head. Even though a cylinder can be continuously rotated a full 360 degrees instead of 180 degrees this is not an advantage for the cylinder shaped head since rotation greater than 180 degrees is an unnatural wrist motion for a person. Finally, with a spherical shaped head, the contact is a point, i.e., the least possible contact area.

In other words, the shape of the mouthpiece of this invention allows for a substantial amount of gum contact without compromising the ability of the gum massager to reach the rear portions of the mouth. Moreover, the soft half-cylinder shaped head allows the gum massager to adjust and conform to the contours of the mouth and teeth which permits massaging of the gums at varying depths, i.e., between the teeth as well as elsewhere in the mouth. This allows for shorter, more closely packed projections and even the use of half-sphere shaped projections while maintaining an ability to massage the gums between the teeth.

The head having more closely packed nodules according to the present invention allows for a much more effective massage than heads having more loosely packed or spaced apart nodules. The maximum number of points of contact are achieved without compromising the massaging ability of the nodules.

Preferably, the gum massager according to the invention is similar in overall shape and size to a toothbrush. The unit is composed of two basic parts. The first part is a plastic handle and the second part is the half-cylinder shaped mouthpiece, preferably formed of rubber or similar material.

The rubber head or mouthpiece preferably has the dimensions of about ½" wide (diameter excluding the nodules) by 1" long by ¼" high (radius excluding the nodules). The plastic handle preferably has a height of about 3/16"; a length of about 4" in the body, 1 ½" in the neck and 1" in the head; and a width of ½" in the body, ¼" in the neck; and ½" in the head. The surface of the mouthpiece is covered with many soft, sturdy nodules. The substance making up these nodules is of soft material, but their geometric structure causes the nodules to be sturdy. The nodules are "sturdy" since they maintain their shape when lateral forces are applied during cleaning and massaging.

A gum massage can be effected by applying the above described periodontal tool to the surfaces or the gums and teeth and employing a gentle massaging technique. The shape of the above tool allows for a plurality of techniques for massaging. A back and forth motion, an up and down motion, a rotational motion, or any combination of the above motion may be used. Advantageously, a firm rotational massage may be used to massage the gums between the teeth and also to clean plaque from therebetween. This rotational massage is best performed by rotating in the direction from the gums toward the teeth.

No pastes or rinses are necessary when using the gum massager. However, appropriate substances may be used to enhance the massaging or cleaning action of the tool according to the invention without departing from the spirit and scope of the invention and its intended use.

The term "rubber" as used throughout the present application is meant to describe any natural or synthetic rubber substance or any substance having rubber-like properties. The word "plastic" as used throughout the present application is meant to describe any plastic or plastic-like substance or any reasonable functional substitute therefor, which is applicable for use in the invention periodontal tool. Materials suitable for use in the invention tool are well developed.

BRIEF DESCRIPTION OF THE DRAWINGS

The invention will be understood more clearly with reference to the accompanying drawing, which drawing also forms a part of this disclosure, and wherein:

FIG. 1 is a perspective view of a periodontal tool according to a first embodiment of the invention;

FIG. 2 is a partial perspective view of the periodontal tool according to all embodiments of the invention and also showing a portion of a person's anatomy upon which the tool may be used;

FIG. 3 is an enlarged transverse cross-sectional view taken on line 3—3 of FIG. 1;

FIG. 4 is an enlarged transverse cross-sectional view taken on line 4—4 of FIG. 1;

FIG. 5 is an enlarged top plan view of the head of FIG. 1;

FIG. 6 is an enlarged transverse cross-sectional view similar to FIG. 3 but showing a second embodiment of the invention;

FIG. 7 is an enlarged top plan view, similar to FIG. 5, but showing the head of FIG. 6;

DETAILED DESCRIPTION OF THE PREFERRED EMBODIMENTS

Figure 8:
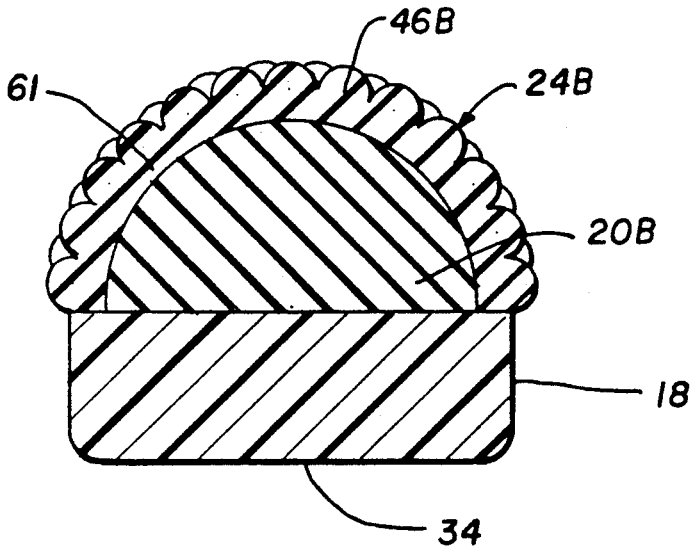
FIG. 8 is an enlarged transverse cross-sectional view similar to FIG. 3 but showing a third embodiment of the invention.

In the description herein, like parts are indicated throughout the specification and drawings with the same reference numerals. Among the several embodiments, similar parts are indicated by the same reference number followed by a letter A, B, etc. The Figures are not drawn to scale; and in some cases portions have been exaggerated in order to more clearly depict the features of the invention.

Referring now to FIG. 1, the invention periodontal tool (e.g., gum massager or plaque removal tool) comprises a tool body 10 comprised of a handle (or body) portion 12, a neck portion 14 and a head support portion 18. Head support portion 18 is permanently attached (e.g., glued, welded or the like) to a head (or mouthpiece) portion or member 20. The head member 20 is of a half-cylinder shape having two end portions 22 and a half-cylindrical outer surface 24 and is attached at its flat surface to the head support portion 18.

The body portion 12, the neck portion 14 and the head support portion 18 are comprised of plastic material and the head (or mouthpiece) portion 20 is made of soft rubber material. Portions 12, 14 and 18 together are similar to a conventional toothbrush without the bristles.

The body portion 12 has a width at surface 28 of about ½ inch, the neck portion 14 at surface 30 has a width of about ¼ inch and the head support portion at 18 has a width at surface 34 of about ½ inch. The head portion 20 is a half-cylinder having a width (diameter excluding the nodules) of about ½ inch, a height (radius excluding the nodules) of about ¼ inch and a length from end portion surface 22 to opposing end portion surface 22 of about one inch. The thickness of portions 12, 14 and 18 is about 3/16 inch as is side surface 26. The neck portion 14 is about 1 ½ inches long and the body portion 12 is about 4 inches long.

Referring now to FIG. 2, the periodontal tool 10 may be applied to a person's oral anatomy 36 at its surface 24 with surface 34 towards the buccal portion of the cheek by inserting portion 18 and all or part of portions 14 and 12 into the mouth by grasping the body at surfaces 26, 28 and 32. This is analogous to the manner of use of a toothbrush. The teeth 38 and gingiva 40 (gums between the teeth and near the teeth) may be cleaned and/or massaged by movement in the manners shown by directional movement arrows A, B and C; that is, longitudinal movement A, transverse movement C and rotational movement B.

Referring now to FIG. 3, an enlarged cross-sectional view of FIG. 1 at section line 3—3 shows the half-sphere shaped nodules 46 and surface 24. FIG. 6 shows the surface 24A of the second embodiment with pointed nodules 52. The surfaces 24 and 24A are comprised of many closely packed nodules (46 and 52 respectively). The nodules may be in a square or even grid pattern, or the rows of points or tops may be offset from adjacent points or tops as shown in FIGS. 5 and 7.

FIG. 4 shows the cross-section of neck 14. FIG. 5 is an enlarged top plan view of the first embodiment of the head comprised of many half-sphere nodules 46. FIG. 7 is a similar enlarged top plan view of the second embodiment of the head of the invention comprised of many pointed nodules 52. The pointed nodules 52 are comprised of isosceles triangular surfaces joined together to form the sides of a polygon having more than three sides, e.g., a square. Accordingly, when the polygon is a square as shown, the pointed nodules 52 of FIG. 7 are of a pyramidal shape.

The unique arrangement of nodules is a primary feature of the invention. They are soft yet sturdy due to being relatively short; i.e., regular pyramidal, half-spheres or the like. Also, they are densely packed together, see FIGS. 5 and 7. These two drawings show the nodules in tight offset rows, but they could also be arranged in aligned rows. Many variations are possible within the teachings of the invention.

While the projections 46 or 52 of surface 24 on head members 20 and 20A are depicted as a single unit head member, the surface 24 or the projections 46 or 52 may be separate members attached to the head member 20 by glue, welding, resin, cement or any other suitable permanent attachment means.

Figure 9:
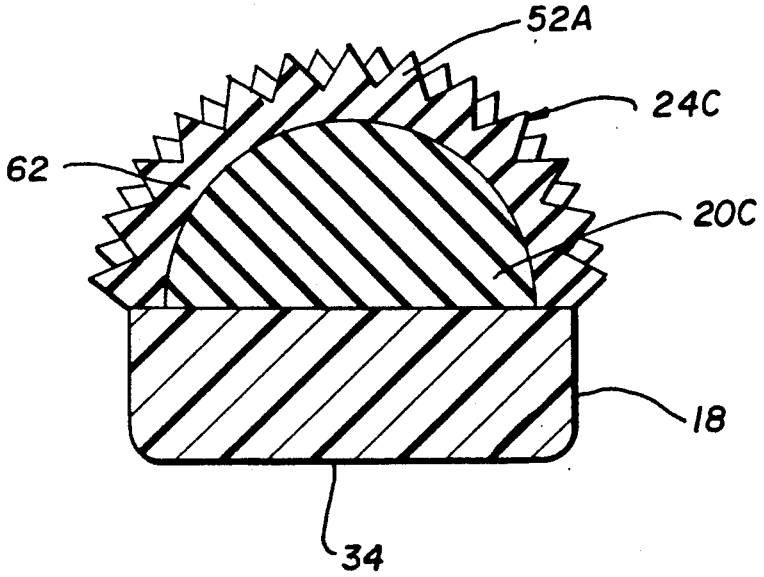
FIG. 9 is an enlarged transverse cross-sectional view similar to FIG. 6 but showing a fourth embodiment of the invention.

FIGS. 8 and 9 are enlarged cross-sectional views of the third and fourth embodiments, respectively, of the invention. FIG. 8 is similar to FIG. 3, but outer surface 24 is formed as a separate outer shell member 61 attached to head member 20B FIG. 9 is similar to FIG. 6, but outer surface 24 is formed as a separate outer shell member 62 attached to head member 20C. The one part structures of FIGS. 3 and 6 and the two part structures of FIGS. 8 and 9 show the versatility of the invention; each may have uses and advantages over the other in a particular environment.

While the invention has been described in some detail above, it is to be understood that this detailed description is by way of example only, and the protection granted is limited only within the spirit of the invention and the scope of the following claims.

I claim:

1. A gum massage or plaque removal periodontal tool, comprising a tool body having, in tandem;

a handle portion;

a neck portion coupled to said handle portion;

a head support portion coupled to said neck portion;

a soft rubber head member coupled to said head support and having a half-cylindrical outer surface with many soft, sturdy nodules on said outer surface; and said nodules being arranged on said half-cylindrical outer surface in closely packed and abutting relationship to each other.

2. A periodontal tool according to claim 1, said nodules being in the shape of half spheres.

3. A periodontal tool according to claim 1, said nodules being pointed nodules with surfaces comprised of isosceles triangles wherein the sides of the triangles together form edges and a point and the bases of each set of triangles for each nodule taken together form the sides of a polygon having more than three sides.

4. A periodontal tool according to claim 3, wherein the polygon base of the nodule is a square, a hexagon or an octagon.

5. A periodontal tool according to claim 4, wherein the polygon base is a square, the nodule is pyramid shaped, and the sides and base edges of the pyramid are all of equal length.

6. A periodontal tool according to claim 1, wherein said nodules are arranged in offset rows.

7. A periodontal tool according to claim 1, said outer surface being formed as a separate outer shell member permanently attached to the head member.

8. A periodontal tool according to claim 1, wherein said nodules are arranged in aligned rows.

9. A periodontal tool according to claim 1, wherein said nodules are relatively short.

10. A gum massage or plaque removal periodontal tool, comprising a tool body having, in tandem;

a handle portion;

a neck portion coupled to said handle portion;

a head support portion coupled to said neck portion;

a soft rubber head member coupled to said head support and having a half-cylindrical outer surface with many soft, sturdy nodules on said outer surface; said nodules being arranged on said half-cylindrical outer surface in closely packed and abutting relationship to each other; and said nodules being arranged on said half-cylindrical outer surface in offset rows;

11. A periodontal tool according to claim 10, said nodules being in the shape of half spheres.

12. A periodontal tool according to claim 10, said nodules being pointed nodules with surfaces comprised of isosceles triangles wherein the sides of the triangles together form edges and a point and the bases of each set of triangles for each nodule taken together form the sides of a polygon having more than three sides.

13. A periodontal tool according to claim 12, wherein the polygon base of the nodule is a square, a hexagon or an octagon.

14. A periodontal tool according to claim 13, wherein the polygon base is a square, the nodule is a pyramid shaped, and the sides and base edges of the pyramid are all of equal length.

15. A periodontal tool according to claim 10, said outer surface being formed as a separate outer shell member permanently attached to the head member.

16. A periodontal tool according to claim 10, wherein said nodules are relatively short.

* * * * *